US005568998A

United States Patent [19]

Egan et al.

[11] Patent Number: 5,568,998

[45] Date of Patent: Oct. 29, 1996

[54] PRECAST WALL PANEL AND GRID CONNECTION DEVICE

[75] Inventors: Philip D. Egan, Atlanta; Robert A. Miller, Marietta, both of Ga.

[73] Assignee: The Tensar Corporation, Atlanta, Ga.

[21] Appl. No.: 389,338

[22] Filed: Feb. 14, 1995

[51] Int. Cl.[6] ..... E02D 29/02

[52] U.S. Cl. ..... 405/262; 405/284; 405/285; 403/391

[58] Field of Search ..... 405/258, 259.1, 405/262, 284, 285, 286; 403/376, 391; 256/19, 24

[56] References Cited

U.S. PATENT DOCUMENTS

| | | | |
|---|---|---|---|
| 4,324,508 | 4/1982 | Hilfiker et al. . | |
| 4,343,571 | 8/1982 | Price . | |
| 4,374,798 | 2/1983 | Mercer . | |
| 4,470,728 | 9/1984 | Broadbent . | |
| 4,476,074 | 10/1984 | Bindhoff . | |
| 4,505,621 | 3/1985 | Hilfiker et al. . | |
| 4,530,622 | 7/1985 | Mercer . | |
| 4,616,959 | 10/1986 | Hilfiker . | |
| 4,661,023 | 4/1987 | Hilfiker . | |
| 4,728,227 | 3/1988 | Wilson et al. . | |
| 4,824,293 | 4/1989 | Brown et al. . | |
| 4,884,921 | 12/1989 | Smith | 405/286 |
| 4,920,712 | 5/1990 | Dean, Jr. . | |
| 4,929,125 | 5/1990 | Hilfiker . | |
| 4,952,098 | 8/1990 | Grayson et al. . | |
| 4,968,186 | 11/1990 | Ogorchock | 405/262 |
| 4,993,879 | 2/1991 | Hilfiker . | |
| 4,998,397 | 3/1991 | Orton . | |
| 5,028,172 | 7/1991 | Wilson et al. . | |
| 5,131,791 | 7/1992 | Kitziller . | |
| 5,145,288 | 9/1992 | Borcherdt . | |
| 5,257,880 | 11/1993 | Janopaul, Jr. | 405/284 |
| 5,419,659 | 5/1995 | Mercer | 405/258 |
| 5,484,235 | 1/1996 | Hilfiker et al. | 405/284 |

OTHER PUBLICATIONS

Newcastle Retaining Wall System (Brochure) (Date Unknown).

Brochure "Concrete GeoWall Package" by Tensar in 1986.

*Primary Examiner*—James A. Lisehora

*Attorney, Agent, or Firm*—Jacobson, Price, Holman & Stern, PLLC

[57] ABSTRACT

Extended lengths of grid-like reinforcing sheet material are attached to precast wall panels of a reinforcing wall by a connector comb and locking clip securing end portions of the reinforcing sheet material between a pair of attachment strips partially embedded in, and extending rearwardly from, the wall panels. The comb connector includes a spine and plurality of upwardly projecting fingers engageable through aligned openings in the attachment strips and the reinforcing sheet material used for soil reinforcement. The locking clip is interengaged with ratchet-like serrated edges formed on the free ends of the fingers of the comb to secure the reinforcing sheet material to the attachment strips.

25 Claims, 5 Drawing Sheets

PRECAST WALL PANEL AND GRID CONNECTION DEVICE

FIELD OF THE INVENTION

This invention relates to a mechanical connection by a connector comb of extended lengths of a grid-like tie-back sheet between two strips of grid-like tie-back sheet projecting from a rear face of precast wall panels to form a reinforced retaining wall.

BACKGROUND OF THE INVENTION

Retaining walls are commonly used for architectural and site development applications. The wall facing must withstand very high pressures exerted by backfill soils. Reinforcement and stabilization of the soil backfill is commonly provided by grid-like sheet materials that are placed in layers in the soil fill behind the wall face to interlock with the wall fill soil and create a stable reinforced soil mass. Connection of the reinforcing material to the elements forming the wall holds the wall elements in place and minimizes soil backfill pressures.

A preferred form of grid-like tie-back sheet material used to reinforce the soil behind a retaining wall structure, known as an integral geogrid, is commercially available from The Tensar Corporation of Atlanta, Ga. ("Tensar") and is made by the process disclosed in U.S. Pat. No. 4,374,798 ("the '798 patent"), the subject matter of which is incorporated herein in its entirety by reference. However, other forms of grid-like tie-back sheet materials have also been used as reinforcing means in the construction of retaining walls, and the instant inventive concepts are equally applicable with the use of such materials. In any event, difficulties are encountered in providing a secure interconnection between the reinforcing means and the wall elements.

In a brochure entitled "Concrete Geowall Package", published by Tensar in 1986, various retaining wall structures are shown using cast concrete panels. In one such retaining wall structure short strips, or tabs, of geogrid material, such as shown in the '798 patent, are embedded in the cast wall panels. On site, longer strips of geogrid are used to reinforce the wall fill, creating a stable soil mass. To connect the geogrid tabs to the reinforcing geogrid, the strands of one portion of geogrid are bent to form loops, the loops are inserted between the strands of the other portion of geogrid so that the loops project out of the second portion of geogrid, and a rod is passed through the loops on the opposite side of the second portion to prevent the loops being pulled back through, thereby forming a tight interconnection between the two portions of geogrid, sometimes referred to as a "Bodkin" joint.

It has been found that this "Bodkin" connection is often difficult to assemble and is time consuming. It is therefore costly to use.

SUMMARY OF THE INVENTION

It is a primary object of this invention to provide a simple and inexpensive precast wall panel system formed of a plurality of precast wall panels and a highly effective grid connection device for securing extended lengths of grid-like reinforcing sheet material to the wall panels.

An important object of this invention is the provisions of a precast wall panel system for forming a retaining wall incorporating a connection device which provides a secure interconnection between a grid-like reinforcing sheet material and selected wall panels having projecting geogrid attachment strips.

According to the present invention, precast concrete wall panels may each measure approximately 5 feet in height by 9 feet wide, although other sizes and shapes are useful, depending on the requirements of the retaining wall to be built. Extended lengths of grid-like reinforcing sheet material are attached to the precast panels by a connector comb engaging a locking clip after the connector comb passes through openings of two geogrid attachment strips extending from the precast panels, and the reinforcing geogrid. Preferably, integral geogrid material, such as is available from Tensar, is used which is capable of transferring 100% of a tensile load by a single junction between the geogrid attachment strips projecting from a precast wall panel and an extended length of grid-like reinforcing sheet material through a connector comb system.

In the precast wall panels according to the present invention, at least one pair of geogrid attachment strips are embedded in a precast concrete wall panel. The two geogrid attachment strips extend out beyond a rear face of the wall panel sufficiently to enable a good connection with the geogrid reinforcement sheet, for example, on the order of approximately 5 inches. At the terminal end of the geogrid attachment strips, projecting from the rear face of the wall panel, is a transversely extending bar, as is found in a uniaxially stretched geogrid. An extended length of reinforcing geogrid material is placed between the geogrid attachment strips projecting from the rear face of the precast wall panel.

A comb connector device formed of a spine and upwardly projecting fingers is inserted up into the apertures formed between the strands of both the geogrid attachment strips projecting from the rear face of the precast wall panel and the extended length of reinforcing geogrid used for soil reinforcement. The comb connector is inserted with the free ends of the fingers of the spine of the comb projecting upwardly beyond the uppermost geogrid attachment strip.

A locking clip having a plurality of slots is pushed over the free ends of the fingers of the comb to lock the comb in place. The fingers are provided with "one-way" ratchet-like serrations, i.e., the locking clip includes engagement ears which are somewhat flexible on opposite sides of the slots spaced to receive the fingers of the comb connector device, the engagement ears riding over angle surfaces of the serrations and precluded from being readily withdrawn as each serration is passed. As the serrated edges of the fingers are pushed into the slots and past the engagement ears, a loud clicking is produced as the engagement ears are spread apart and then snap around the ends of the serrated edges of the fingers to indicate a locking of the engagement ears between serrations of the fingers.

The clips may be approximately 4 to 5 inches long and approximately 1 to 2 clips may be spaced over a 16 inch length of the comb connector device. Therefore, not every finger need be engaged by a slot of the locking clip. The locking clip is made of either a spring metal or plastic such that the engagement ears may be spread apart and will be biased to return to their initial configuration as they pass over the serrations on the comb fingers.

The precast wall panels may be made of concrete formed over a pattern of crossed rebars or horizontally extending rebars welded to vertically oriented welded wire mesh (WWM). The end of the geogrid attachment strips opposite to the end engaged by the comb connector device are embedded in the approximate middle of the concrete wall panel, adjacent to horizontally extending rebars.

The geogrid attachment strips are preferably of a thickness of about one-half of the thickness of the reinforcing geogrid. Thus, the combined strength of each pair of geogrid attachment strips is approximately equal to the strength of a single reinforcing geogrid captured therebetween.

Accordingly, it is another object of the present invention to construct a retaining wall of a plurality of precast concrete wall panels having two geogrid attachment strips extending therefrom with an extended length of reinforcing geogrid secured therebetween by a connector comb engaging a locking clip.

It is still yet another object of the present invention to provide a retaining wall made up of a plurality of panels having at least one pair of geogrid attachment strips projecting therefrom with a reinforcing geogrid secured therebetween by a connector comb engaged with a locking clip with the fingers of the comb extending through openings between the strands of the geogrid attachment strips and the reinforcing geogrid.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
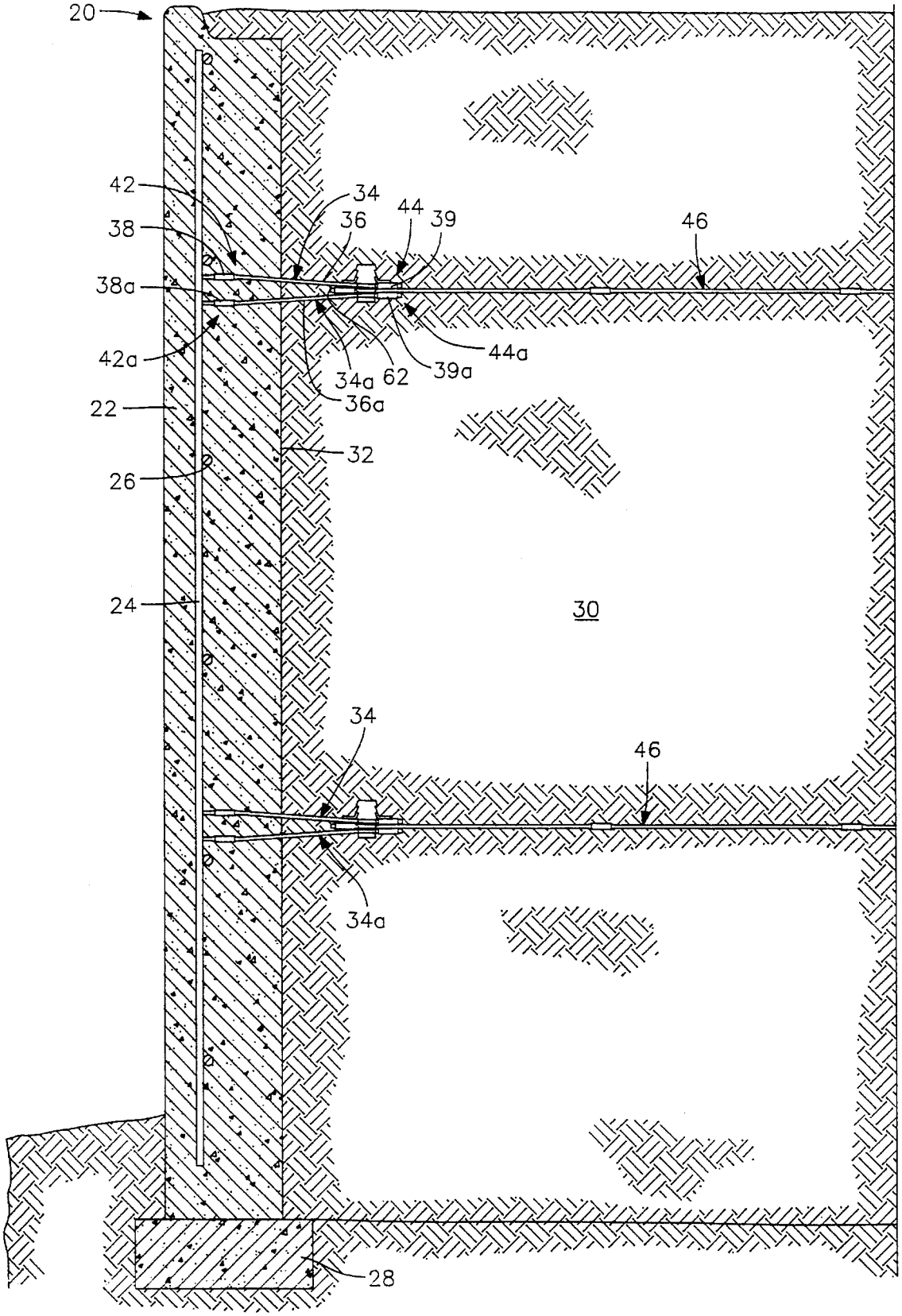
FIG. 1 shows a cross-sectional view of a precast panel according to the present invention in situ with a comb connector securing small lengths of geogrid attachment strips embedded in the precast panel to a length of geogrid extending through and reinforcing the soil.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 4, in particular, one embodiment of a precast wall panel with a comb connection device connecting a reinforcing geogrid to geogrid attachment strips extending form the wall panel, embodying the teachings of the subject invention, is generally designated as 20.

It should be understood that, although several preferred embodiments of precast wall panels are shown herein, the structural details of the wall panel itself are not critical to the instant invention concepts. Likewise, while a uniaxially stretched integral geogrid according to the teachings of the '798 patent is the preferred reinforcing material and is also preferred for the attachment strips, other suitable materials may be readily substituted therefore without departing from the instant invention concepts.

With reference to FIG. 1, the precast wall panel 22, reinforced by vertically extending rebars 24 welded to horizontally extending rebars 26, is shown standing on an unreinforced concrete leveling pad 28. The leveling pad 28 is formed of concrete which is allowed to cure for a minimum of 12 hours prior to placing panel 22 on top of the pad.

A plurality of the precast wall panels 22, made of concrete, form a retaining wall for retaining earth or fill material 30. The fill material 30 contacts a rear face 32 of the panel 22.

At least one pair of vertically spaced geogrid attachment strips 34, 34*a* is embedded in the panel 22. Each geogrid attachment strip is formed of longitudinally extending strands 36, 36*a* and transverse bars 38, 39, 38*a*, 39*a* together defining openings 40, 40*a*. The bars 38, 38*a* at one end 42, 42*a* of each strip are embedded in the panel 22. The opposite ends 44, 44*a* include bars 39, 39*a* extending freely from the rear face 32 of the panel 22 for a distance of, on the order of, approximately 5 inches. As shown in FIG. 1, the panel 22 may include two or more pairs of geogrid attachment strips 34, 34*a*.

For reinforcing the fill material 30, a plurality of horizontally extending, reinforcing geogrids 46 extend through the fill material 30. The reinforcing geogrid 46 includes a plurality of longitudinally extending strands 48 interconnected by transversely extending bars 50 defining openings 52 between adjacent strands.

Figure 6:
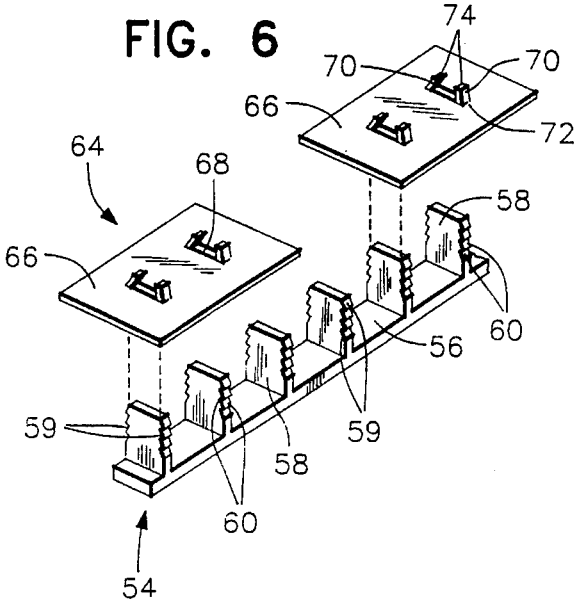
FIG. 6 is an exploded view of a comb connector and two locking clips.

To connect the reinforcing geogrid 46 between the geogrid attachment strips 34, 34*a*, a connector comb 54 as shown in FIG. 6 is used. The connector comb 54 includes a spine 56 and a plurality of upwardly projecting fingers 58. Each of the fingers 58 includes a plurality of "one-way" serrations on its side edges forming teeth 60.

The fingers 58 of connector comb 54 are inserted through the openings 40*a* of the lower geogrid attachment strip 34*a*, adjacent to the bar 38*a*, which is located exteriorly of the panel 22. The fingers of the comb then pass through the openings 52 of reinforcing geogrid 46, adjacent to the bar 50 at the terminal end 62 thereof. The fingers 58 then pass up through the openings 40 of the upper geogrid attachment strip 34. The spacing between the fingers 58 is equal to the spacing between openings 40, 40*a* of the geogrid attachment strips 34, 34*a* as well as the openings 52 of the reinforcing geogrid 46.

To secure the connector comb 54 in place, and to lock the reinforcing geogrid 46 between the two geogrid attachment strips 34, 34*a* a locking clip 64 is used. Locking clip 64 is a flat plate 66, preferably made of metal or plastic, having a plurality of slots 68 with a width of the slots greater than the width of the fingers 58. At opposite ends of the slot 68, are a pair of opposed spring-like engagement ears 70 which are cut on three sides from the plate 66. The opposed free ends 74 of the ears 70 are deflected upwardly away from the plate 66 as the plate 66 is pressed downwardly over the angled surfaces 59 of the teeth 60 and are biased to return to their initial configuration as they pass below each of the teeth 60. As the free ends 74 of the ears 70 pass by each tooth 60 of the fingers 58, the free ends 74 of the ears 70 snap below each tooth 60 with a loud click. Continued downward movement of the locking clip 64 over the fingers 58 will result in the positioning of the locking clip to the position shown in FIG. 3 where the locking clip cannot be pushed down any further.

Figure 2:
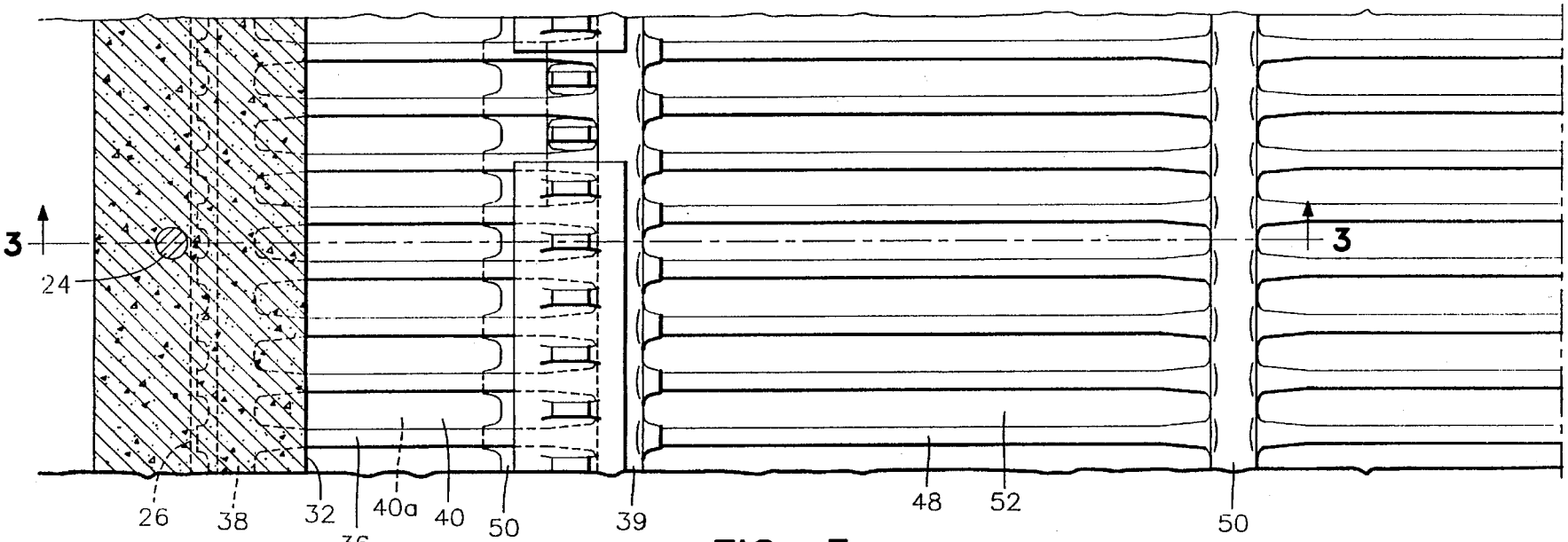
FIG. 2 is a plan view of a precast panel thereof.
Figure 3:
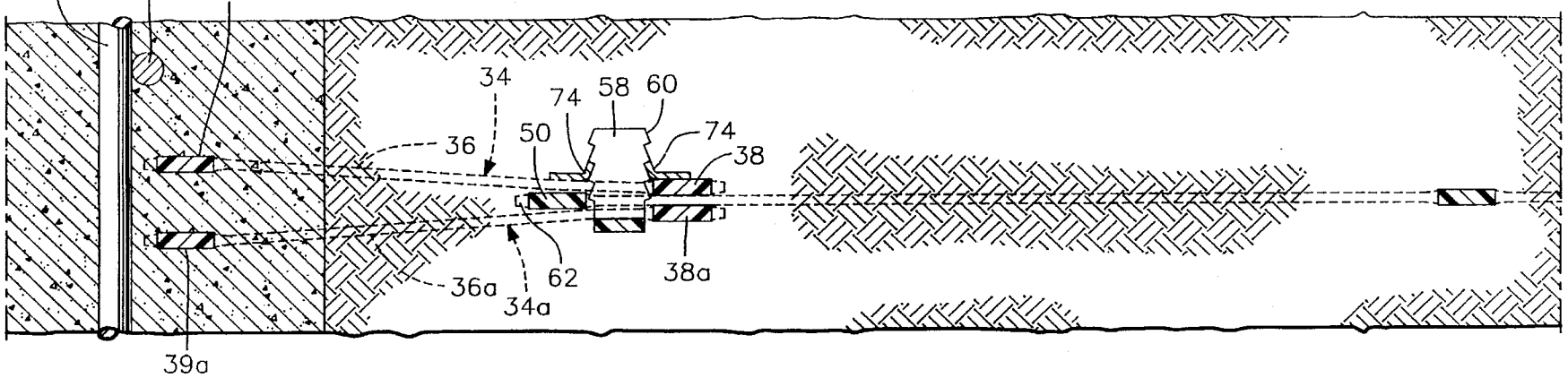
FIG. 3 is a sectional view taken along line 3—3 of FIG. 2.

In the position shown in FIG. 3, the free ends 74 of the locking ears 70 engage the finger 58 between successive teeth 60. In this position, the locking clip 64 cannot be moved upwardly from the fingers 58 due to the upward incline of the ears 70 and the "one-way" nature of the teeth 60. Accordingly, when the locking clip is engaged with the comb connector device 54, the reinforcing geogrid 46 is secured between the geogrid attachment strips 34, 34*a*. As shown in FIG. 2, a plurality of short locking clips 64 may be used, spaced along the length of a single comb connector device 54, which is preferably about 16 inches long, to facilitate the locking engagement.

Figure 4:
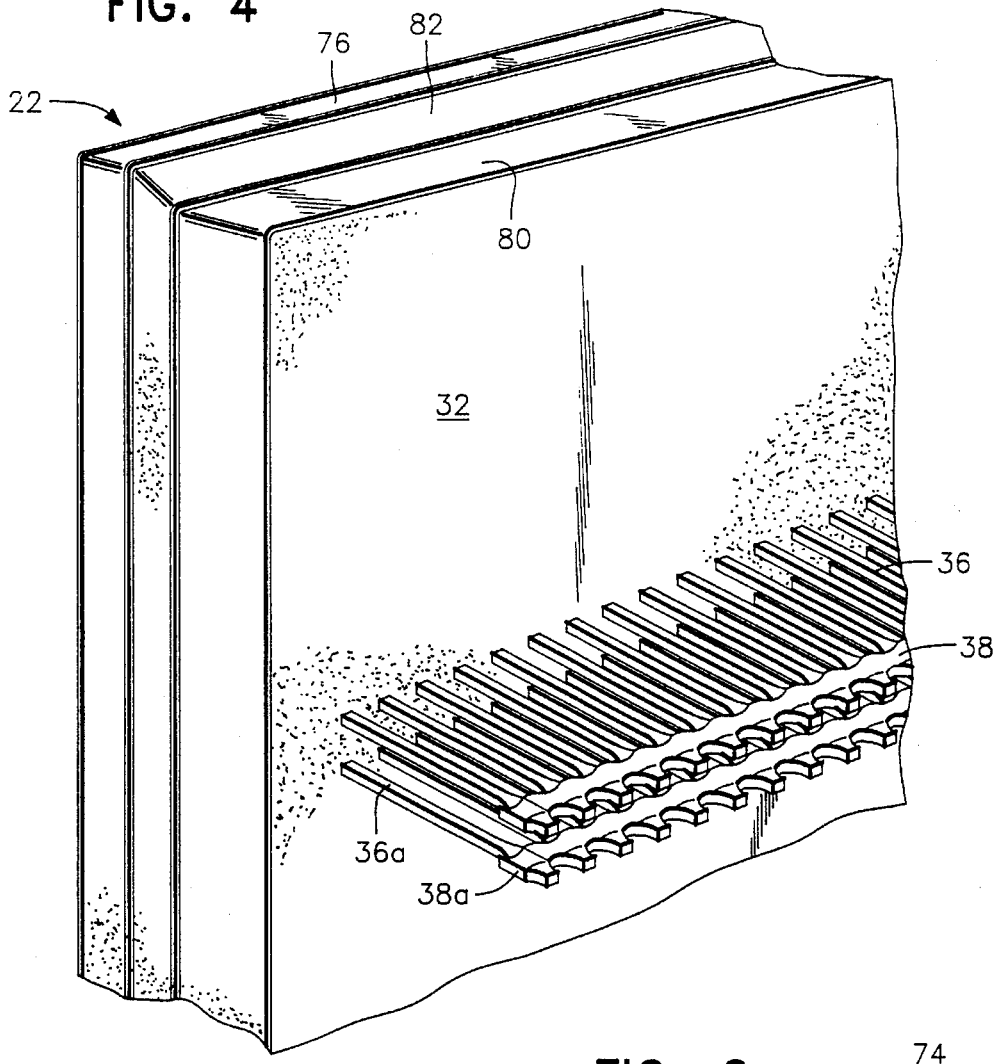
FIG. 4 illustrates a portion of a precast panel with two small lengths of geogrid attachment strips extending therefrom.
Figure 5:
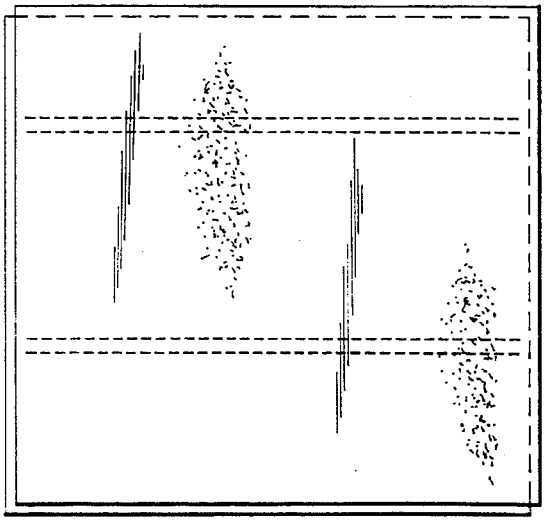
FIG. 5 is a front view of a precast panel according to this invention.
Figure 9:
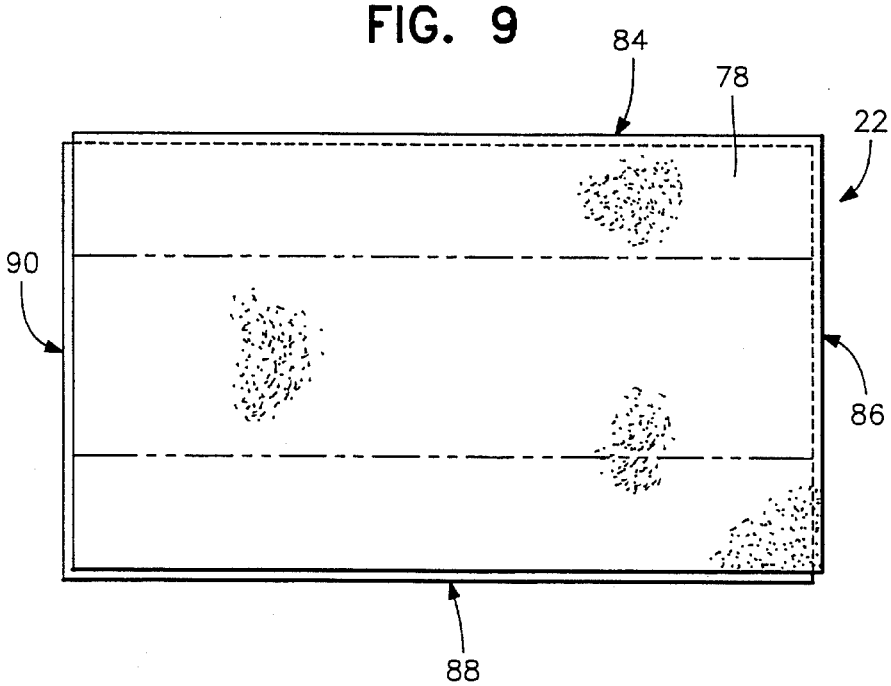
FIG. 9 is a front view of an alternative embodiment of a precast panel according to this invention.
Figure 10:
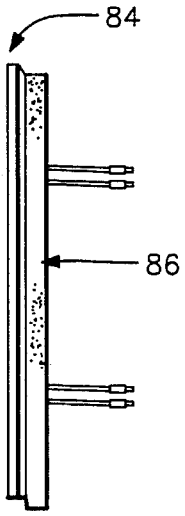
FIG. 10 is a side view of the precast panel shown in FIG. 9.
Figure 11:
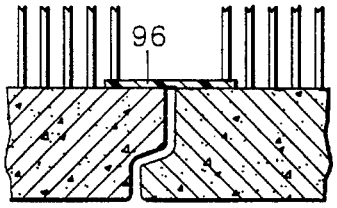
FIG. 11 shows a vertical joint detail of two adjacent precast panels.
Figure 12:
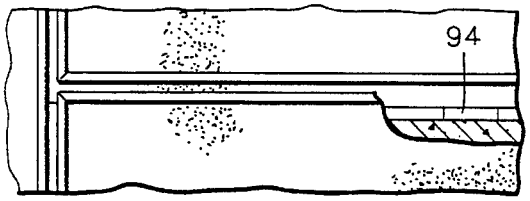
FIG. 12 is a partial cross-sectional view of an enlarged area illustrating the seams formed between three precast panels and a neoprene or polymeric pad located between vertically stacked panels.

In some embodiments of the precast wall panel of the present invention, the edges of the wall panel 22 may be stepped from the rear face 32 or front face 78 to include, as shown in FIGS. 4, 5 and 9, a rearwardly extending surface 76, extending from the front face 78 of a panel 22 stepping down to a surface 80 extending from the rear face 32, along a transitional surface 82. The configuration of a panel, as shown in FIGS. 9 and 10, includes a top edge 84 and a lateral edge 86 with surface 76 projecting beyond surface 80. However, at bottom edge 88 and lateral edge 90, the surface 80 projects beyond the surface 76.

Figure 7:
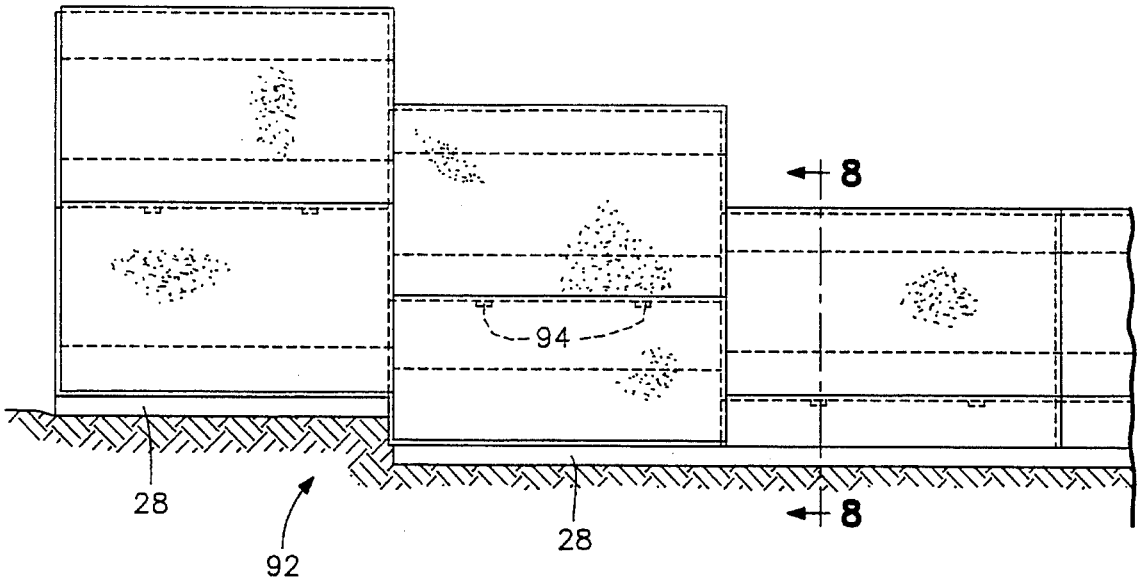
FIG. 7 is a front view of a plurality of courses of stacked precast panels according to the present invention situated on an unreinforced concrete leveling pad.
Figure 13:
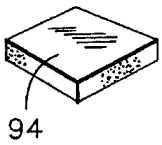
FIG. 13 is an enlarged detailed perspective view of a neoprene or polymeric pad used for insertion between vertically stacked panels.
Figure 8:
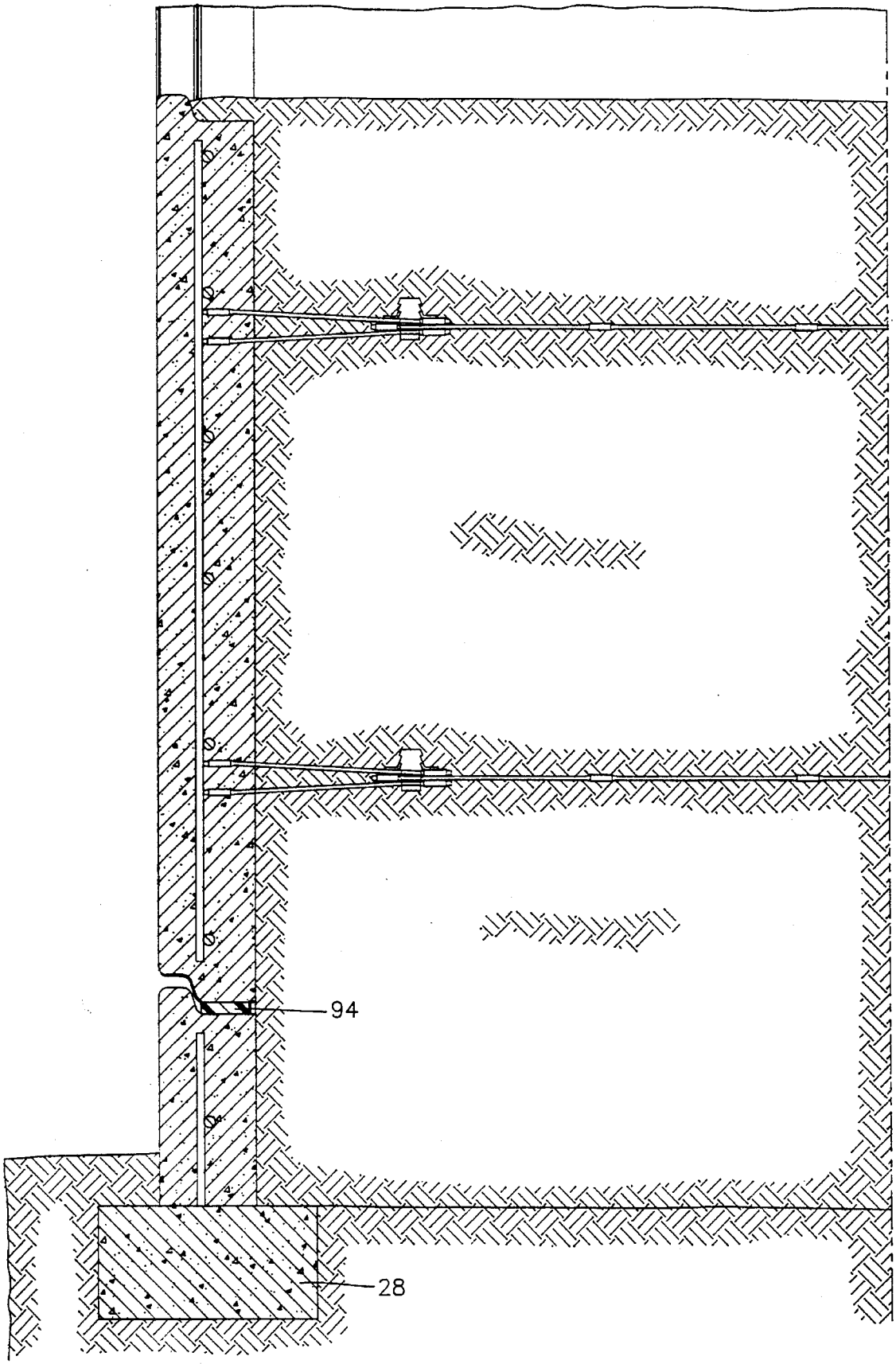
FIG. 8 is a cross-sectional view taken along line 8—8 of FIG. 7.

The configuration of panels shown in FIGS. 5 and 9 provides for an interlocking of adjacent panels along both vertically and laterally extending seams in the construction of a retaining wall 92 as shown in FIGS. 7 and 8. Neoprene or polymeric pad 94, as shown in FIG. 13, may be placed between vertically adjacent panels 22 in such a construction. Along the rear face 32, on opposite sides of the horizontal and vertical seams between adjacent panels, a six inch wide non-woven geotextile 96 may be placed, trimmed along the vertical seams to fit around the geogrid attachment strips 34, 34*a* extending from the rear face 32.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A retaining wall comprising:

a plurality of precast wall panels each having a rear face and a front face and complementary shaped edges for interengagement with each other, each wall panel including at least one pair of vertically spaced attachment strips extending from said rear face, said attachment strips defining a multiplicity of vertically aligned openings adjacent said rear wall of said panel, a reinforcing sheet material including an end portion positioned between said attachments strips and defining openings aligned with said openings in said attachment strips, the remainder of said reinforcing sheet material extending into fill material located behind said rear faces of said panels, and a connector device including a plurality of fingers extending through at least some of said aligned openings in said attachment strips and said reinforcing sheet material for securing said attachment strips and said reinforcing sheet material together.

2. A retaining wall as claimed in claim 1, wherein said connector device includes a connector comb including said plurality of fingers, and at least one locking clip secured over the ends of at least some of said fingers.

3. A retaining wall as claimed in claim 2, wherein said connector comb includes a spine and a plurality of fingers extending from said spine.

4. A retaining wall as claimed in claim 3, wherein said fingers are spaced along said spine at a distance equal to a multiple of the spacing of said aligned openings in said attachment strips and said reinforcing sheet material.

5. A retaining wall as claimed in claim 3, wherein side edges of said fingers are serrated for cooperation with said locking clip.

6. A retaining wall as claimed in claim 3, wherein said locking clip includes at least one slot having engagement ears extending into said slot for engaging free ends of said fingers of said connector comb.

7. A retaining wall as claimed in claim 6, wherein the spacing between said engagement ears is less than the width of said fingers.

8. A retaining wall as claimed in claim 6, wherein said attachment strips and said reinforcing sheet material are retained between said spine and said locking clip.

9. A retaining wall as claimed in claim 8, wherein a plurality of locking clips are spaced along said connector comb.

10. A retaining wall as claimed in claim 1, wherein one end of each attachment strip is embedded in a panel.

11. A retaining wall as claimed in claim 10, wherein said attachment strips each comprises a uniaxially stretched integral geogrid material comprising a plurality of longitudinal strands interconnected by transverse bars together defining said openings.

12. A retaining wall as claimed in claim 11, wherein said reinforcing sheet material also comprises a uniaxially stretched integral geogrid.

13. A retaining wall as claimed in claim 12, wherein each of said geogrid attachment strips of a pair are approximately half as thick as said reinforcing geogrid.

14. A retaining wall comprising:

a plurality of wall panels vertically stacked and laterally aligned, said wall panels each including a front face and a rear face with at least one pair of vertically spaced attachment strips extending from said rear face of selected panels, said attachment strips of each pair defining a multiplicity of vertically aligned openings adjacent said rear wall of their associated panel, fill material located behind said rear faces, an elongated reinforcing strip having one end intermediate said attachment strips, with the remainder extending into said fill material, said one end of said reinforcing strip defining openings aligned width said openings in said attachment strips, and a connector device connecting said attachment strips to each other and to said reinforcing strip.

15. A retaining wall as claimed in claim 14, wherein said reinforcing strip is a geogrid material.

16. A retaining wall as claimed in claim 14, wherein said attachment strips are embedded in said panels.

17. A retaining wall comprising:

a plurality of wall panels vertically stacked and laterally aligned, said wall panels each including a front face and a rear face with at least one pair of vertically spaced attachment strips extending from said rear face of selected panels, said attachment strips of each pair defining a multiplicity of vertically aligned openings adjacent said rear wall of their associated panel, fill material located behind said rear faces, an elongated reinforcing strip having one end intermediate said attachment strips, with the remainder extending into said fill material, said one end of said reinforcing strip defining openings aligned with, said openings in said attachment strips, and a connector device connecting said attachment strips to each other and to said reinforcing strip, wherein said connector device includes a connector comb and at least one locking clip.

18. A retaining wall as claimed in claim 17, wherein said connector comb includes a spine and a plurality of fingers extending from said spine.

19. A retaining wall as claimed in claim 18, wherein said fingers are spaced along said spine at a distance equal to a multiple of the spacing between aligned openings in said reinforcing strip and said attachment strips.

20. A retaining wall as claimed in claim 18, wherein side edges of said fingers are serrated for cooperation with said locking clip.

21. A retaining wall as claimed in claim 20, wherein said locking clip includes at least one slot having engagement ears extending into said slot for engaging free ends of said fingers of said connector comb.

22. A retaining wall as claimed in claim 21, wherein the spacing between said engagement ears is less than the width of said fingers.

23. A retaining wall comprising:

a plurality of wall panels vertically stacked and laterally aligned, said wall panels each including a front face and a rear face with at least one pair of vertically spaced attachment strips extending from said rear face of selected panels, said attachment strips of each pair defining a multiplicity of vertically aligned openings adjacent said rear wall of their associated panel, fill material located behind said rear faces, an elongated reinforcing strip having one end intermediate said attachment strips, with the remainder extending into said fill material, said one end of said reinforcing strip defining openings aligned with said openings in said attachment strips, and a connector device connecting said attachment strips to each other and to said reinforcing strip, wherein the thickness of each attachment strip is approximately half of the thickness of said reinforcing strip.

24. A wall panel of a retaining wall, said wall panel comprising:

a front face, a rear face, and at least one pair of spaced attachment strips extending from said rear face with the spacing therebetween accommodating a reinforcing sheet material having a thickness substantially twice the thickness of each attachment strip so that said pair of attachment strips provide a strength substantially equal to the strength of a reinforcing sheet material to be secured therebetween.

25. A wall panel as claimed in claim 24 adapted to be used with a uniaxially stretched geogrid reinforcing sheet material, wherein said attachment strips each comprise a strip of uniaxially stretched geogrid comprising a plurality of laterally spaced strands interconnected by transverse bars to define openings, at least one bar of each strip being embedded in the material of said wall panel, and at least one bar of each strip being spaced from said rear face of said wall panel.

* * * * *